US006164347A

United States Patent [19]

Dahlmann

[11] Patent Number: 6,164,347

[45] Date of Patent: Dec. 26, 2000

[54] CONDIMENT RECEPTACLE HOLDER

[76] Inventor: T. Lee Dahlmann, 770 Claremont Dr., Morgan Hill, Calif. 95037

[21] Appl. No.: 09/253,298

[22] Filed: Feb. 19, 1999

[51] Int. Cl.[7] ..... B67D 1/00

[52] U.S. Cl. ..... 141/370; 141/369; 141/391; 248/311.2

[58] Field of Search ..... 141/369, 370, 141/372, 390, 391, 88; 248/311.2, 312, 312.1; 222/108, 385

[56] References Cited

U.S. PATENT DOCUMENTS

| | | | |
|---|---|---|---|
| 558,660 | 4/1896 | Reissing | 222/108 |
| 699,481 | 5/1902 | Boyd | 222/108 |
| 702,181 | 6/1902 | Boyd | 222/108 |
| 857,674 | 6/1907 | Riecke | 141/372 |
| 1,061,099 | 5/1913 | Miller | 222/108 |
| 1,703,284 | 2/1929 | Wolfe | 222/108 |
| 1,898,866 | 2/1933 | Bragger | 248/311.2 |
| 2,095,201 | 10/1937 | Mills | 141/370 |
| 2,105,339 | 1/1938 | Sweitzer | 222/385 |
| 2,591,507 | 4/1952 | Brous | 141/370 |
| 2,696,091 | 12/1954 | Bueno | 222/108 |
| 3,881,677 | 5/1975 | Ihlenfeld | 248/311 |
| 3,913,792 | 10/1975 | Brill | 222/144.5 |
| 4,640,483 | 2/1987 | Tufte | 248/311.2 |
| 4,658,872 | 4/1987 | Ellis | 141/311 R |
| 4,869,404 | 9/1989 | Elliot | 222/385 |
| 5,190,257 | 3/1993 | Gradel | 248/231.7 |
| 5,244,175 | 9/1993 | Frankel | 248/311.2 |
| 5,309,960 | 5/1994 | Boyd | 141/391 |
| 5,375,746 | 12/1994 | Schaefer | 222/385 |
| 5,381,932 | 1/1995 | Humphrey | 222/321 |
| 5,470,011 | 11/1995 | Jordan | 222/108 |
| 5,842,671 | 12/1998 | Gibbs | 248/231.41 |

*Primary Examiner*—J. Casimer Jacyna

[57] ABSTRACT

A holder for supporting a condiment receptacle closely below the dispensing aperture of a condiment dispensing pump is disclosed having a support body to hold the receptacle and an attachment body to connect the holder to the dispensing pump. The support body contains an opening below the dispensing aperture such that any condiment dispensed without a receptacle on the holder will fall through the opening not contacting any part of the holder. A recess in the support body allows the condiment receptacle to be correctly positioned on the holder and prevents the receptacle from moving out of position. The holder employs the use of a hanger and snap fit clip to releasibly attach the holder to a condiment dispensing pump. The holder can also be made to be a permanent part of a condiment dispensing pump.

4 Claims, 7 Drawing Sheets

CONDIMENT RECEPTACLE HOLDER

BACKGROUND—FIELD OF INVENTION

This invention relates generally to a receptacle holder, and more particularly to a condiment receptacle holder which is used in conjunction with a condiment dispensing pump.

BACKGROUND—DESCRIPTION OF PRIOR ART

Many fast food restaurants use condiment pumps for the purpose of allowing their patrons to dispense ketchup and various other condiments into disposable receptacle cups. Typically, these pumps are placed on a counter top next to napkin dispensers and straw dispensers. These counter top areas frequently become quite crowded as several people load straws, napkins, and condiments onto their food trays. Existing condiment pumps have dispensing apertures far above the counter top. This requires the user to hold the condiment receptacle closely underneath the dispensing aperture in one hand while actuating the pump with the other hand as exemplified by U.S. Pat. No. 4,869,404 to Elliott (1989), U.S. Pat. No. 5,375,746 to Schaefer (1994), and U.S. Pat. No. 5,381,932 to Humphrey (1995). The requirement to use both hands forces the patron to set down his or her food tray onto the counter before filling the condiment receptacle. Additionally, any other item the patron is carrying, such as a newspaper, must also be set down. Consequently, the amount of time each patron spends at the counter area is lengthened creating a bottle neck effect on the flow of patrons through this portion of the restaurant. Frequently, a patron must wait in line to have access to the condiment dispenser creating an inconvenience to the patron. The fact that filling a condiment receptacle is a two handed operation is unfortunate since all other typical activities at these counter areas, such as obtaining a straw or napkin, can be accomplished by one hand while the patron holds the tray in the other. Thus, the filling of condiment receptacles is the primary reason patrons set down their trays onto these counter tops.

An additional problem is that there is often not enough room on the counter top for the patron to set down his or her tray and anything else that is being carried. This is partially caused by the placement of napkin dispensers, straw dispensers, condiment receptacles, beverage lids, and the like on the counter top, as well as other patrons' trays. Often there is spilled beverages or condiments on the counter top also detracting from the usable area since it is undesirable to set anything down into the spill. This lack of counter space causes many patrons to support only a partial area of their tray on the counter top while the rest of the tray overhangs the counter and is unsupported. This required balancing act creates further inconvenience to the patron and also increases the likelihood of dropped trays.

OBJECTS AND ADVANTAGES

Accordingly, an object of the present invention is to make it possible for a restaurant patron to fill a condiment receptacle using only one hand by providing a receptacle support closely underneath the dispensing aperture of the condiment pump. The patron can thus place the receptacle on the holder, actuate the pump, and remove the filled receptacle all with the same hand eliminating the need to set down a food tray prior to filling the receptacle.

Another object of the present invention is to provide a receptacle support closely underneath the dispensing aperture of a condiment pump that does not get dirtied with condiment if the condiment pump is actuated without a receptacle being put in place onto or into the support. Similarly, an object of the present invention is to provide a condiment receptacle support closely underneath the dispensing aperture of a condiment pump that allows dispensed condiment to fall cleanly through the support when no receptacle is used. This functionality will preserve the ability for a patron to dispense condiment directly onto food, such as french fries or a hamburger bun, rather than into a receptacle.

Another object of the present invention is to provide a receptacle support that indicates to the user exactly where the receptacle should be placed on the support such that the receptacle is directly underneath the dispensing aperture of the condiment pump. A further object of the present invention is to provide a receptacle support that prevents the receptacle from sliding out of place such that the condiment always falls into the center of the receptacle.

Another object of the present invention is to provide a receptacle support that can be securely attached to a condiment pump in such a way that the support can not be rotated or slid out of position relative to the dispensing aperture of the condiment pump. Thus, the support will be prevented from being knocked out of position if accidently bumped by a patron.

Another object of the present invention is to provide a condiment receptacle support that is easily removable from a condiment pump to facilitate cleaning of the support and pump. A further object of the present invention is to provide a receptacle support that is easily attachable to existing condiment pumps allowing them to be retrofitted with a receptacle support.

Further objects and advantages of the invention will become apparent from a consideration of the drawings and ensuing description.

Reference Numerals in Drawings

Figure 1:
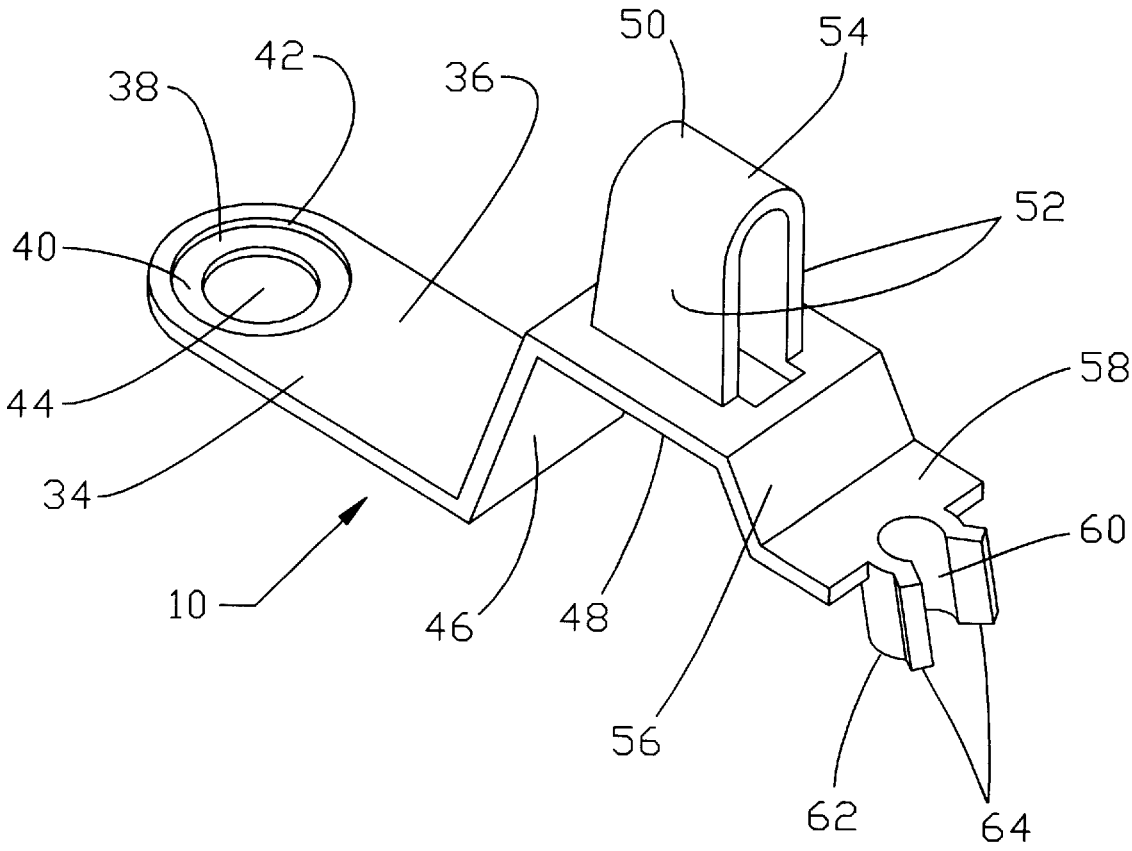
FIG. 1 is an isometric illustration of a specific illustrative embodiment of the invention.

| | | | |
|---|---|---|---|
| 10 | condiment receptacle holder | 12 | condiment receptacle |
| 14 | outside wall | 16 | bottom |
| 18 | top | 20 | condiment dispensing pump |
| 22 | container | 24 | dispensing tube |
| 26 | angled portion | 28 | forward portion |
| 30 | downward portion | 32 | dispensing aperture |
| 34 | support body | 36 | top surface |
| 38 | recess | 40 | bottom surface |

-continued

| Reference Numerals in Drawings | | | |
|---|---|---|---|
| 42 | inside wall | 44 | opening |
| 46 | upward projection | 48 | attachment body |
| 50 | hanger | 52 | hanger walls |
| 54 | hanger top | 56 | downward projection |
| 58 | rear member | 60 | snap fit clip |
| 62 | c-shaped portion | 64 | outward flares |
| 66 | horizontal leg | 68 | vertical leg |
| 70 | underside | 110 | condiment receptacle holder |
| 120 | condiment dispensing pump | 122 | container |
| 124 | dispensing tube | 126 | angled portion |
| 128 | forward portion | 130 | downward portion |
| 132 | dispensing aperture | 134 | support body |
| 142 | inside wall | 144 | opening |
| 148 | attachment body | | |

SUMMARY

This invention is a support for a condiment receptacle that is attachable or integral with a condiment pump. The support is located closely underneath the dispensing aperture of the pump allowing users to fill a receptacle using only one hand. An open area in the support directly underneath the dispensing aperture prevents the support from accumulating condiment.

DESCRIPTION OF THE PREFERRED EMBODIMENTS

The entire condiment receptacle holder is referred to generally by the reference numeral 10. A condiment receptacle is referred to generally by the reference numeral 12 having an outside wall 14, a bottom 16, and a top 18. A condiment dispensing pump is referred to generally by the reference numeral 20. The condiment dispensing pump comprises a container 22 and a dispensing tube 24. The dispensing tube 24 comprises an angled portion 26 which rises from the pump container 22 and slightly tilts forward. The angled portion 26 then bends mostly forward forming a forward portion 28. The forward portion then bends downward forming a downward portion 30 at the end of which is a dispensing aperture 32.

Figure 2:
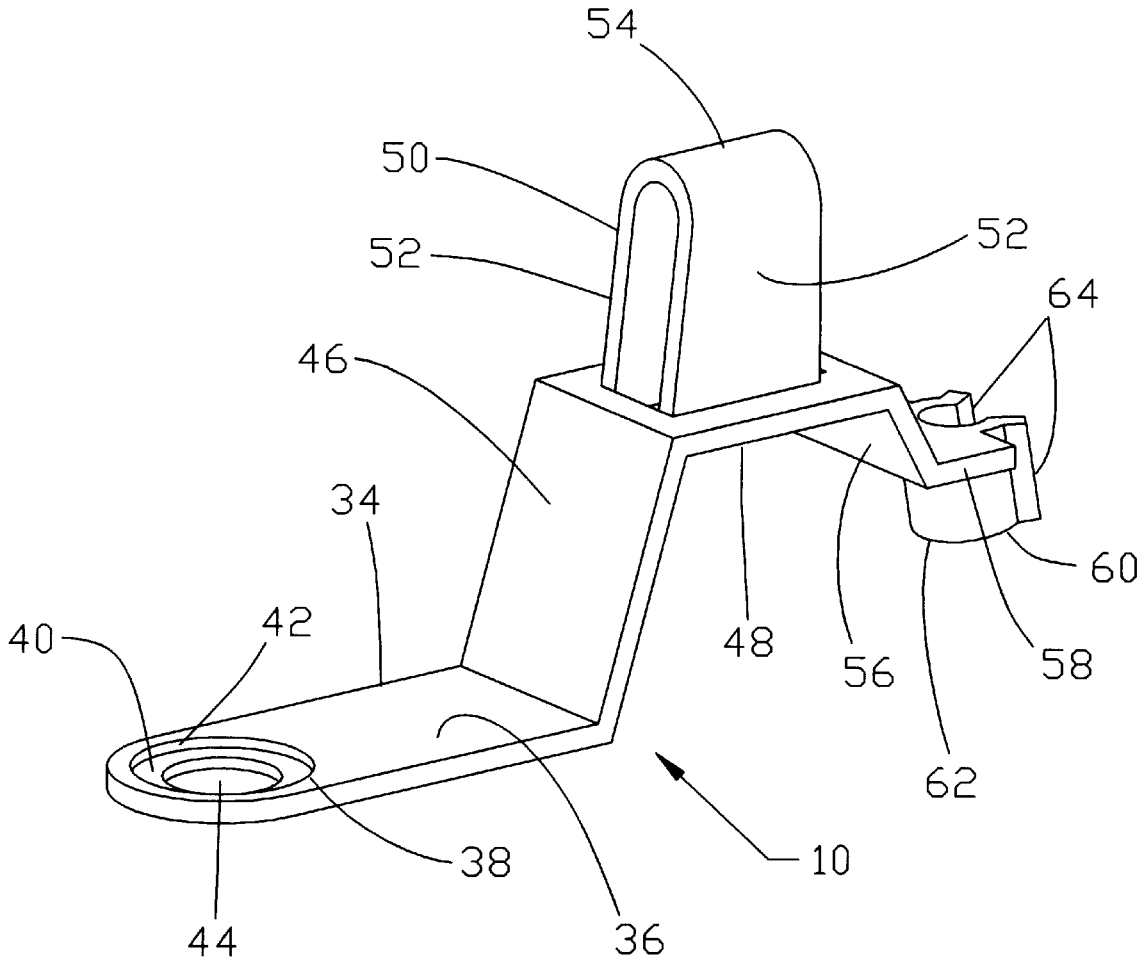
FIG. 2 is an isometric illustration of the embodiment shown in FIG. 1 shown from another angle.

One typical embodiment of the invention is illustrated in FIG. 1 and FIG. 2. The condiment receptacle holder 10 is of single piece construction and is injection molded in a strong durable plastic such as ABS. The condiment receptacle holder 10 comprises a support body 34 which is preferably horizontal and has a top surface 36. The support body 34 includes a recess 38 which contains a bottom surface 40 and an inside wall 42. The recess 38 is preferably round in shape and is large enough to allow the bottom 16 of the condiment receptacle 12 to fully sit on the bottom surface 40 of the recess 38 without the condiment receptacle 12 having room to slide from side to side. The recess 38 is deep enough to give its inside wall 42 sufficient height to oppose transverse movement of the condiment receptacle in directions parallel to the bottom surface 40 of the recess 38. The bottom surface 40 contains an opening 44. The opening 44 is round in shape and is smaller is diameter than the recess 38. The opening 44 is as large as possible while still maintaining enough surface area of the bottom surface 40 of the recess 38 to support the condiment receptacle 12 in a stable manner without tipping.

Attached to the support body 34 is an upward projection 46 which connects to an attachment body 48 of the condiment receptacle holder 10. Rising from the attachment body 48 is a hanger 50. The hanger 50 comprises two hanger walls 52 which are mostly vertical and which are connected at the top by a hanger top 54. The hanger walls 52 must be taller than the downward portion 30 of the dispensing tube 24 to facilitate installation of the condiment receptacle holder 10 onto the condiment dispensing pump 20. The hanger walls 52 are spaced apart at a distance slightly greater than the diameter of the dispensing tube 24 of the condiment pump 20. In the preferred embodiment, the hanger top 54 is semicircular in shape, conforming to the diameter of the dispensing tube 24. The vertical distance between the hanger top 54 and the bottom surface 40 of the recess 38 determines how far below the dispensing aperture 32 the condiment receptacle 12 will be supported. This distance must be large enough to allow easy placement and removal of the condiment receptacle 12 onto the condiment receptacle holder 10 without interference with the downward portion 30 of the dispensing tube 24. However, this distance must also be short enough to ensure that condiment dispensed without the condiment receptacle 12 placed on the condiment receptacle holder 10 will fall through the opening 44 without contacting the bottom surface 40 of the recess 38. In the preferred embodiment, a distance of approximately 3 inches is used, however other distances will also suffice.

Attached to the attachment body 48 is a downward projection 56 which extends downward from the opposite side of the attachment body 48 that the upward projection 46 is connected to. The downward projection 56 connects to a rear member 58 which extends rearward. A snap fit clip 60 is connected to the opposite end of the rear member 58 that the downward projection 56 is. The snap fit clip 60 comprises a c-shaped portion 62 and two outward flares 64. The snap fit clip 60 is angled suitably to engage the angled portion 26 of the dispensing tube 24. Additionally, the diameter of the c-shaped portion 62 is sized to tightly engage the angled portion 26 of the dispensing tube 24. The downward projection 56 and the rear member 58 must position the snap fit clip 60, relative to the recess 38, such that the recess 38 will be directly underneath the dispensing aperture 32 when the condiment receptacle holder 10 is clipped onto the condiment dispensing pump 20.

Figure 6:
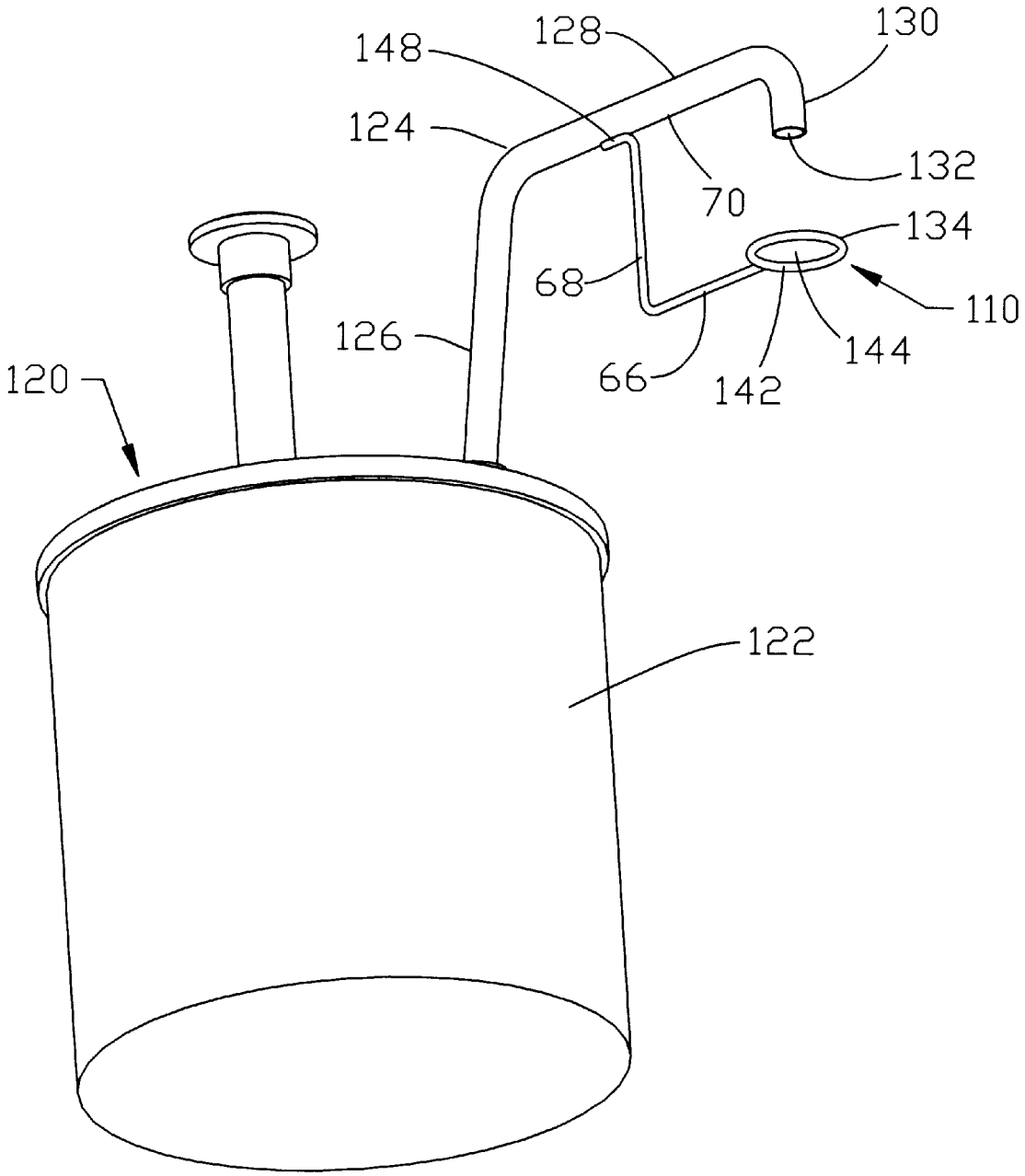
FIG. 6 is an isometric illustration of a specific illustrative embodiment of the invention.
Figure 7:
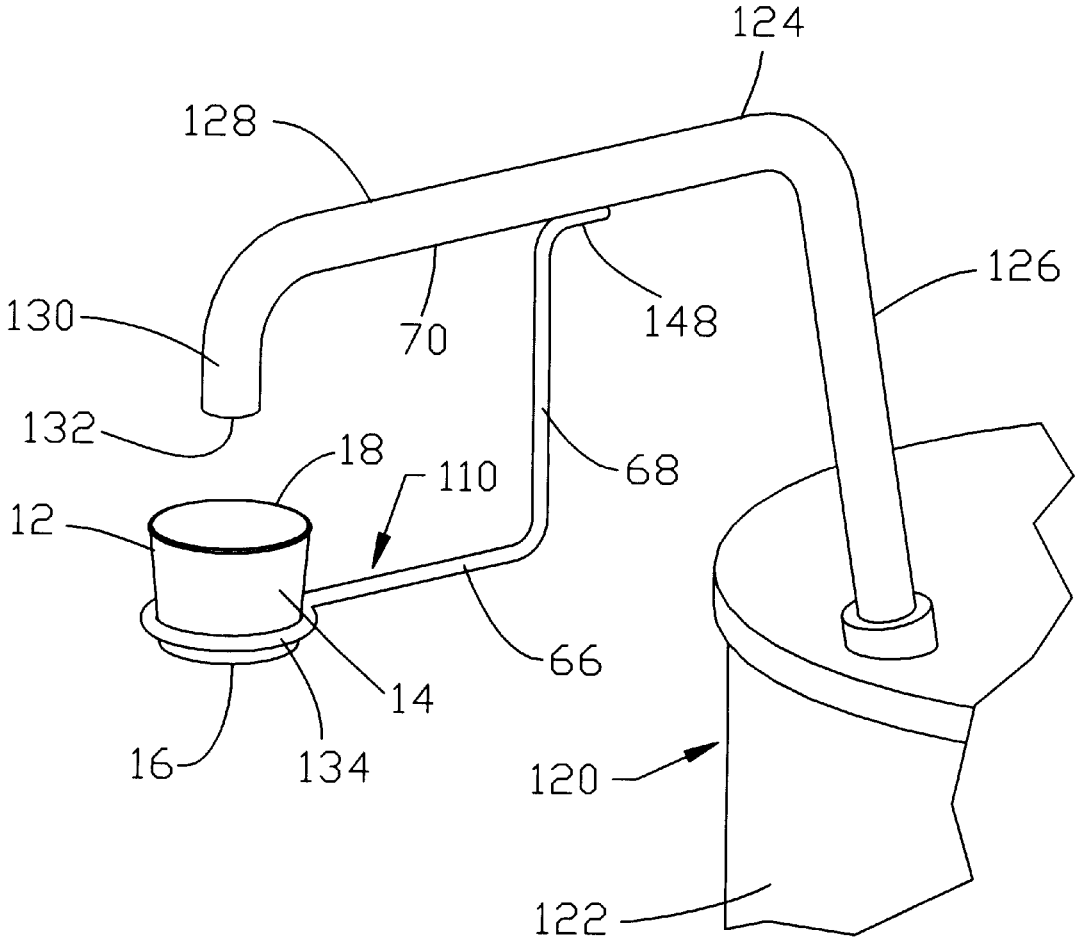
FIG. 7 is an isometric illustration of the embodiment shown in FIG. 6 holding a condiment receptacle.

Another embodiment of the invention is shown in FIG. 6 and FIG. 7 where the condiment receptacle holder 110 is a permanently attached and integral part of the condiment pump 120. The condiment pump 120 includes a container 122 and a dispensing tube 124. The dispensing tube 124 comprises an angled portion 126 which rises from the pump container 122 and slightly tilts forward. The angled portion 126 then bends mostly forward forming a forward portion 128. The forward portion then bends downward forming a downward portion 130 at the end of which is a dispensing aperture 132. In this embodiment, the condiment receptacle holder 110 is made of steel wire construction. The condiment receptacle holder 110 comprises a support body 134 which is circular in shape forming an opening 144 with an inside wall 142. Extending rearward from the support body 134 is a horizontal leg 66 which is bent upward to form a vertical leg 68. The vertical leg 68 extends upward towards the dispensing tube 124. The vertical leg 68 is bent substantially rearward forming an attachment body 148 which is parallel to the forward portion 128 of the dispensing tube 124. The attachment body 148 is welded or otherwise fastened to an underside 70 of the forward portion 128 of the dispensing tube 124.

The length of the vertical leg 68 must be long enough such that the condiment receptacle 12 can easily be placed in and removed from the condiment receptacle holder 110 without interference from the downward portion 130 of the dispensing tube 124. Additionally, the length of the vertical leg 68 must be short enough such that condiment dispensed without the condiment receptacle 12 in place falls cleanly through the opening 144 without contacting the support body 134. In the preferred embodiment, a length of 2.5 inches is used for the vertical leg 68, however other lengths would also be sufficient.

Additionally, the length of the horizontal leg 66 and the attachment location on the dispensing tube 124 of the attachment body 148 must be such that the support body 134 is centered about the dispensing aperture 132 to ensure that condiment will fall in the center of the condiment receptacle 12.

Figure 5:
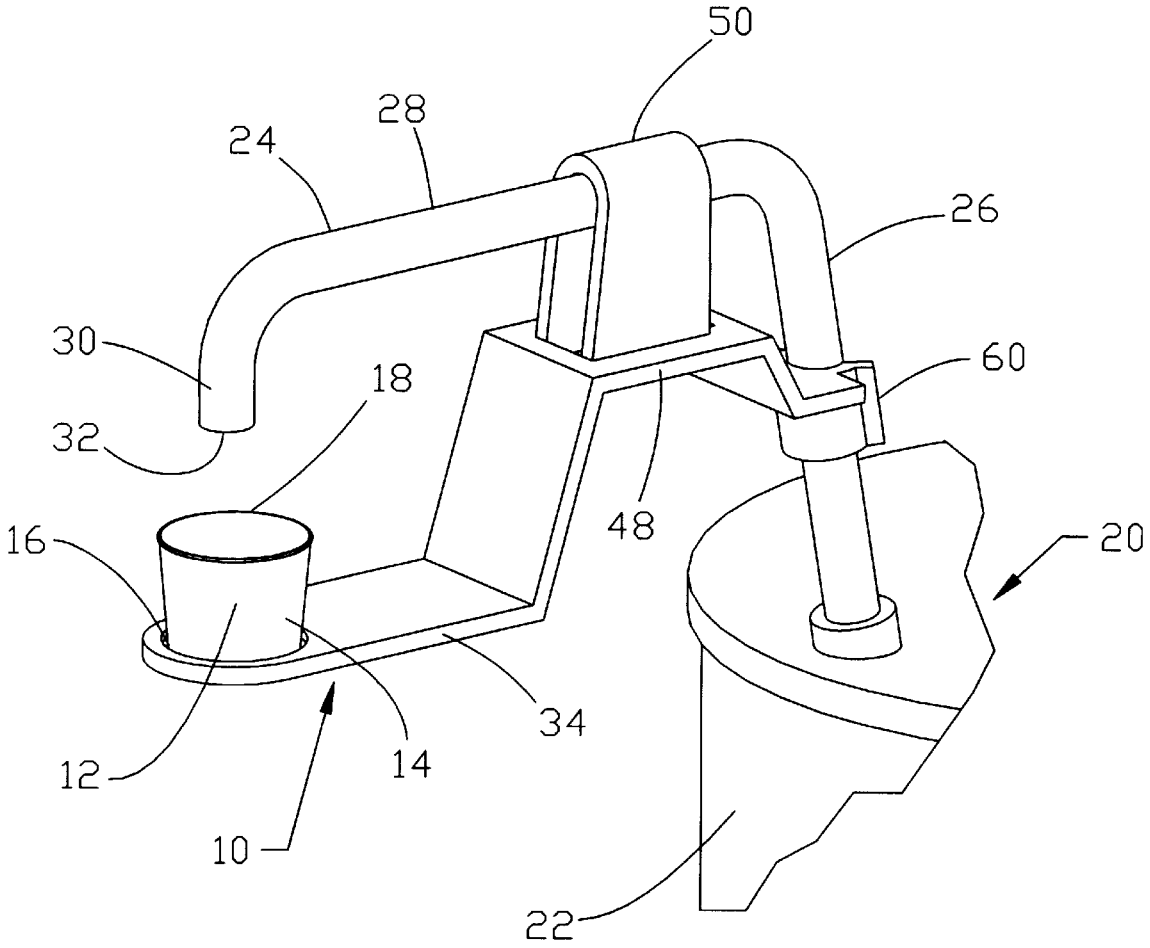
FIG. 5 is an isometric illustration of the embodiment shown in FIGS. 1 and 2 holding a condiment receptacle.

Operation—FIGS. 5 and 7

Figure 3:
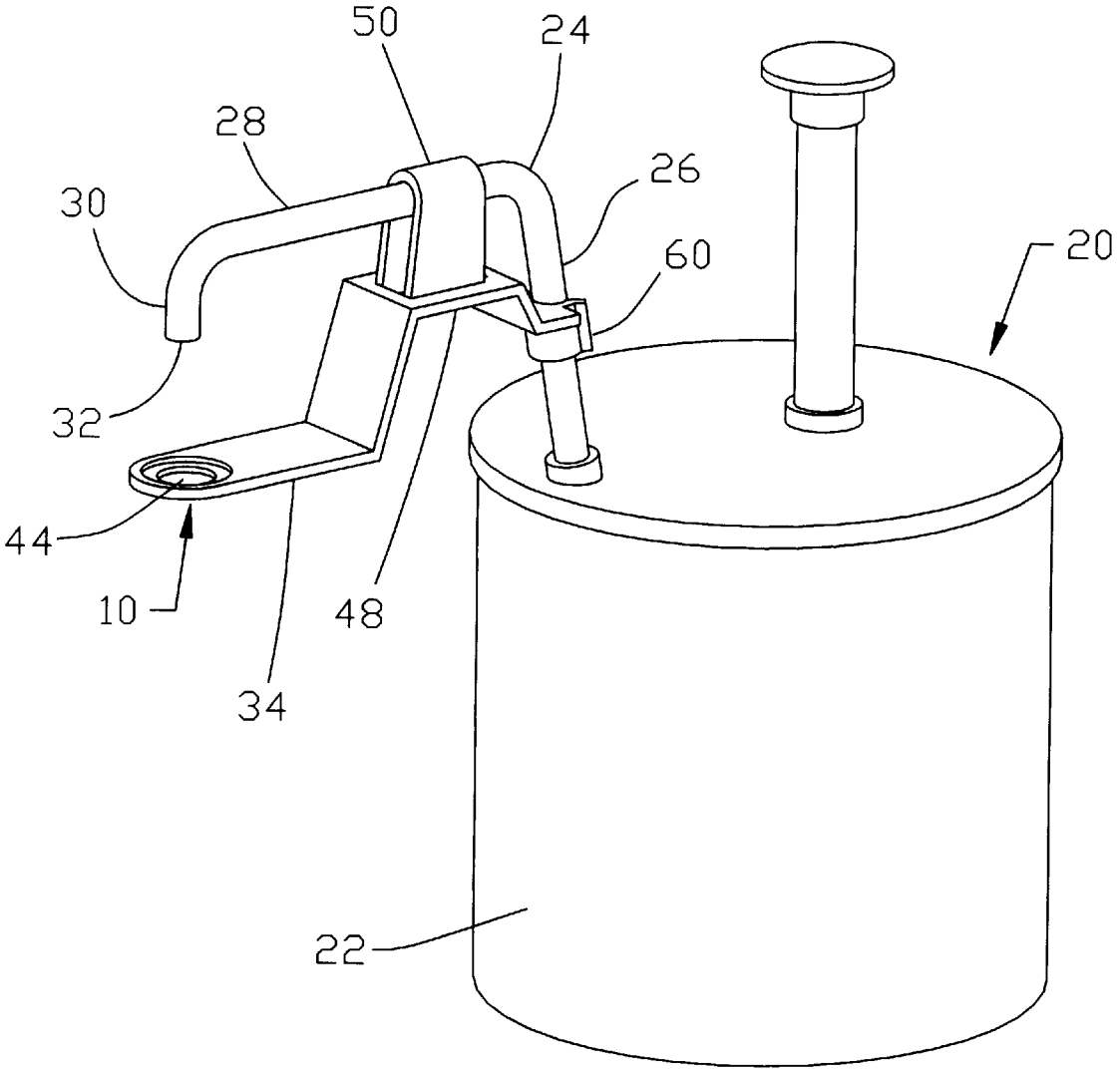
FIG. 3 is an isometric illustration of the embodiment shown in FIGS. 1 and 2 installed onto a condiment pump.
Figure 4:
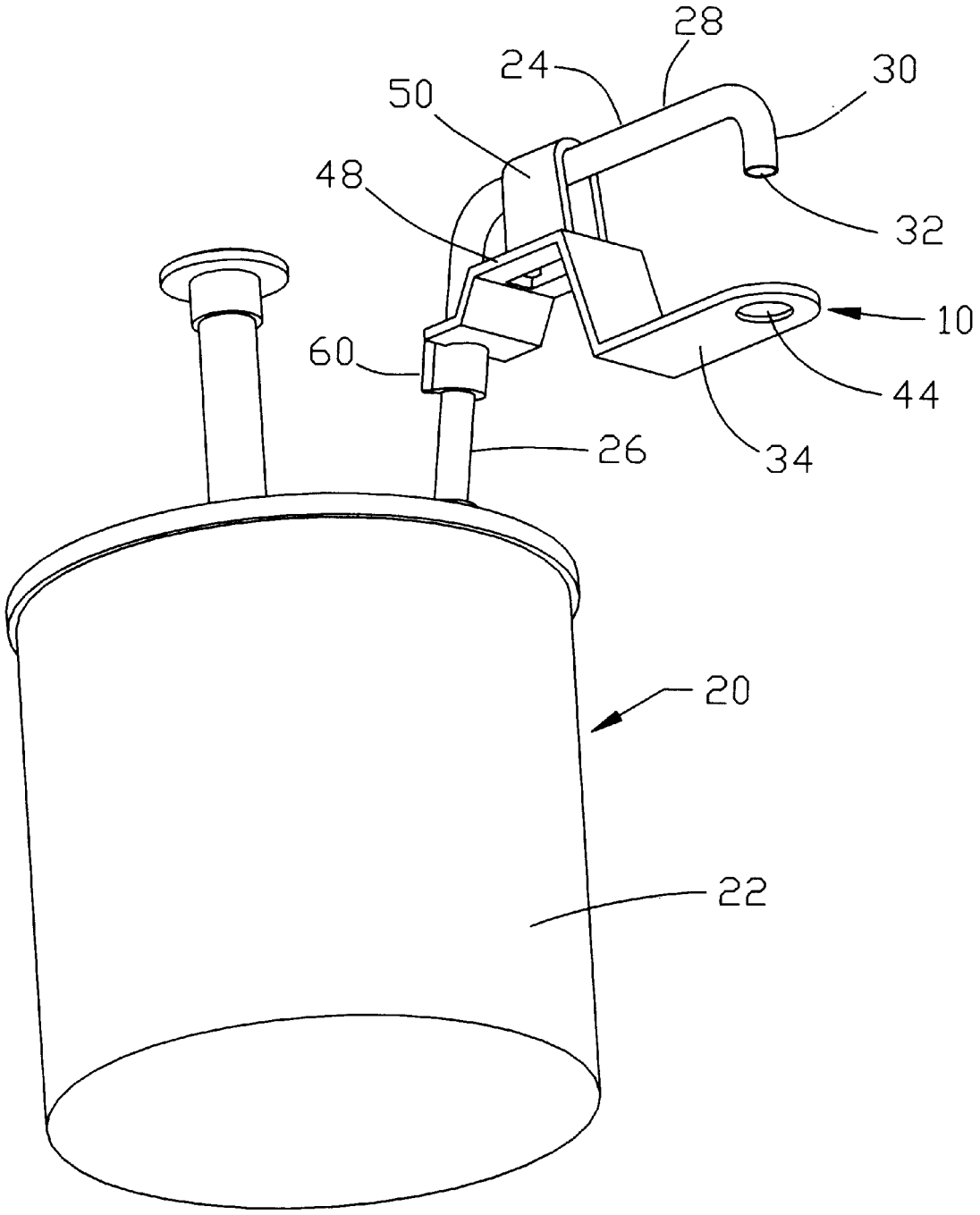
FIG. 4 is similar to FIG. 3 only shown from a different angle.

Prior to use, the attachable embodiment must first be installed onto the condiment pump 20 by a restaurant employee as shown in FIG. 3 and FIG. 4. To accomplish this, the hanger 50 of the condiment receptacle holder 10 is slid over the downward portion 30 of the dispensing tube 24. The receptacle holder 10 is then slid towards the angled portion 26 of the dispensing tube 24 with the hanger 50 hanging from the forward portion 28 of the dispensing tube 24. The snap fit clip 60 engages and snaps onto the angled portion 26 of the dispensing tube 24 readying the condiment receptacle holder 10 for use.

In use, a restaurant patron obtains a condiment receptacle 12 with one hand, and then places the condiment receptacle bottom 16 down into the recess 38 and onto its bottom surface 40 as shown in FIG. 5. The recess 38 acts to correctly position the condiment receptacle 12 on the condiment receptacle holder 10 and prevents it from moving out of position. The empty condiment receptacle 12 is now directly below the dispensing aperture 32 of the condiment dispensing pump 20. The hand that was used to place the condiment receptacle 12 is now free to actuate the condiment dispensing pump 20, filling the condiment receptacle 12. The same hand is then used to remove the full condiment receptacle 12 from the condiment receptacle holder 10 to be placed on the patron's food tray. This process can be carried out using one hand only, allowing the other hand to hold a food tray or other item during the entire process.

For instances when a patron wants to apply condiment directly onto a food item rather than into the condiment receptacle 12, the food item is held below the opening 44. The condiment dispensing pump 20 is then actuated. Condiment falls from the dispensing aperture 32, through the opening 44, and onto the food item without contacting any portion of the condiment receptacle holder 10. Similarly, if the condiment dispensing pump 20 is, for any reason, actuated without a condiment receptacle 12 placed onto the condiment receptacle holder 10, the condiment will fall through the opening 44 leaving the condiment receptacle holder 10 clean for the next patron's use.

The condiment receptacle holder 10 can be easily removed from the condiment pump 20 for cleaning purposes. This is accomplished by pulling the condiment receptacle holder 10 away from the angled portion 26 of the dispensing tube 24 unclipping the snap fit clip 60. Then condiment receptacle holder 10 is pulled off the condiment pump 20 in the opposite manner that it was installed.

Operation of the embodiment which is integral with the condiment dispensing pump 120 is similar, as shown in FIG. 7. The restaurant patron obtains a condiment receptacle 12 with one hand and places it down into the opening 144 of the support body 134. The outside wall 14 of typical condiment receptacles 12 is angled such that the top 18 of the condiment receptacles 12 are larger in diameter than the bottom 16 of the condiment receptacles 12 to allow them to nest together for stacking purposes. Thus, the condiment receptacle 12 will settle downward until the outside wall 14 of the condiment receptacle 12 comes in contact with the inside wall 142 of the opening 144. In the preferred embodiment, approximately 20% of the condiment receptacle 12 hangs below the support body 134 as shown in FIG. 7. Most of the condiment receptacle 12 is thus above the support body 134 for easy retrieval by the patron's hand. At this point, the empty condiment receptacle 12 is fully supported and ready to be filled. The patron uses the same hand to actuate the condiment pump 120 causing condiment to eject from the dispensing aperture 132 of the dispensing tube 124 and fall into the condiment receptacle 12 supported below. The filled condiment receptacle 12 is then returned to the patron's tray. Again, the entire filling operation is able to be conducted with one hand only, eliminating the need for the patron to set down the food tray to free up both hands.

As with the attachable embodiment, if the condiment pump 120 is, for any reason, actuated without a condiment receptacle 12 placed into the support body 134, the condiment will fall through the opening 144 without coming into contact with any part of the condiment receptacle holder 110. This prevents the undesirable accumulation of condiment onto the condiment receptacle holder 110.

Accordingly, this invention allows restaurant patrons a much quicker and more convenient way of filling condiment receptacles with a condiment pump. Additionally, it will reduce the amount of crowding in the counter top areas of restaurants which are used for condiment receptacle filling as well as napkin, straw and beverage lid dispensing. Furthermore, the invention will reduce the occurrence of spilled food trays at these counter top areas since the food trays will no longer have to be balanced on the edge of the counter when little counter top space is available.

Although the descriptions above contain many specifics, these should not be construed as limiting the scope of the invention but as merely providing illustrations of some of the presently preferred embodiments of this invention. For example, the attachable embodiment could support the condiment receptacle by its side wall rather than by its bottom as the embodiment integral with a condiment pump was shown to do. Other means could also be used to support the condiment receptacle. Other means could be used to attach the holder to a condiment pump. The recess could be of a shape other than circular. Different manufacturing methods and materials could be used other than those described, etc.

Thus the scope of the invention should be determined by the appended claims and their legal equivalents, rather than by the examples given.

I claim:

1. A holder for supporting a condiment receptacle proximally underneath a dispensing aperture formed by a dispensing tube of a condiment pump, the holder comprising:

(a) a substantially horizontal support body for holding the condiment receptacle in a substantially upright orientation at a first end of said holder;

(b) a substantially vertical hanger having a top support surface matching a cooperating portion of a forward portion of the dispensing tube at an intermediate portion of said holder thereby providing vertical stability; and (c) a snap-fit clip having an angled c-shaped portion matching a cooperating portion of an angled portion of the dispensing tube at a second end of said holder thereby providing lateral stability.

2. A holder for supporting a condiment receptacle proximally underneath a dispensing aperture formed by a dispensing tube of a condiment pump, the holder comprising:

(a) a substantially horizontal support body for holding the condiment receptacle in a substantially upright orientation at a first end of said holder;

(b) a substantially horizontal intermediate portion of said holder with an upper surface of said intermediate portion offset from an upper surface of said first end of said holder;

(c) a substantially vertical hanger having a top support surface matching a cooperating portion of a forward portion of the dispensing tube rising from said upper surface of said intermediate portion; and (d) a snap-fit clip having an angled c-shaped portion matching a cooperating portion of an angled portion of the dispensing tube at a second end of said holder thereby providing lateral stability.

3. The holder of claims 1 or 2 wherein the support body forms an opening, the opening being located such that it will be below the dispensing aperture of the dispensing tube when the holder is secured to the dispensing tube.

4. The holder of claims 1 or 2 wherein the support body forms a recess large enough for the condiment receptacle to sit in such that the condiment receptacle is positioned underneath the dispensing aperture of the dispensing tube when the holder is secured to the dispensing tube.

* * * * *